US008796619B1

(12) United States Patent
Doroshenko et al.

(10) Patent No.: US 8,796,619 B1
(45) Date of Patent: Aug. 5, 2014

(54) ELECTROSTATIC ORBITAL TRAP MASS SPECTROMETER

(71) Applicant: Science and Engineering Services, LLC., Columbia, MD (US)

(72) Inventors: Vladimir M. Doroshenko, Sykesville, MD (US); Alexander Misharin, Columbia, MD (US)

(73) Assignee: Science and Engineering Services, LLC, Columbia, MD (US)

( * ) Notice: Subject to any disclaimer, the term of this patent is extended or adjusted under 35 U.S.C. 154(b) by 0 days.

(21) Appl. No.: 13/915,264

(22) Filed: Jun. 11, 2013

(51) Int. Cl.
*H01J 3/00* (2006.01)
*H01J 49/42* (2006.01)
*H01J 49/26* (2006.01)

(52) U.S. Cl.
USPC ..... 250/292; 250/282; 250/281; 250/288; 250/290

(58) Field of Classification Search
CPC ..... H01J 49/26; H01J 49/425; H01J 49/02; H01J 49/4245; H01J 49/0031; H01J 49/0036
USPC ..... 250/282, 292, 281, 288, 283, 290
See application file for complete search history.

(56) References Cited

U.S. PATENT DOCUMENTS 7,728,290 B2 * 6/2010 Makarov ..... 250/297
8,384,019 B2 * 2/2013 Koster et al. ..... 250/281
8,476,586 B2 * 7/2013 Misharin et al. ..... 250/283

OTHER PUBLICATIONS

R.D. Knight, "Storage of ions from laser-produced plasma"; Nov. 18, 1980, pp. 221-223.
Andriy Kharchenko et al., "Performance of Orbitrap Mass Analyzer at Various Space Charge and Non-Ideal Field Conditions: Simulation Approach"; American Society for Mass Spectrometry, Feb. 22, 2012, pp. 978-987.
Qizhi Hu et al., "The Orbitrap: a new mass spectrometer"; Journal of Mass Spectrometry, Mar. 15, 2005, pp. 430-443.
Alexander Makarov,"Electrostatic Axially Harmonic Orbital Trapping: A High-Performance Technique of Mass Analysis"; Analytical Chemistry, vol. 72, No. 6, Mar. 15, 2000.
Yehia Ibrahim et al., "Improving Mass Spectrometer Sensitivity Using a High-Pressure Electrodynamic Ion Funnel Interface", American Society for Mass Spectrometry, Jun. 9, 2006, pp. 1299-1305.

* cited by examiner

*Primary Examiner* — Nikita Wells
(74) *Attorney, Agent, or Firm* — Oblon, Spivak, McClelland, Maier & Neustadt, L.L.P.

(57) ABSTRACT

An orbital ion trap for electrostatic field ion trapping which includes an electrode structure defining an internal volume of the trap with at least some of electrode surfaces shaped to substantially follow equipotential lines of an ideal quadrologarithmic electric potential around a longitudinal axis z. The ideal electric potential has an inner potential canyon, an outer potential canyon, and a low potential passage therebetween. The trap includes a trapping voltage supply which provides trapping voltages on the electrodes to generate a trapping electrostatic potential within the internal volume of the trap. The trapping electrostatic potential closely approximates at least a part of the ideal electric potential in at least a part of the internal volume of the trap.

32 Claims, 13 Drawing Sheets

$E_{min}$
$E_{max}$
E,eV
ρ, mm
540
520
500
480
460
440
420
400
380
360
340
320
300
280
19.4
19.6
19.8
20.0
20.2
20.4
20.6
20.8
21.0

ELECTROSTATIC ORBITAL TRAP MASS SPECTROMETER

BACKGROUND OF THE INVENTION

1. Field of the Invention

This invention relates to mass spectrometers and more specifically to electrostatic orbital trap (OT) mass spectrometers (MS), and methods and systems for the detection of ions in mass spectrometers using orbital traps.

2. Description of the Related Art

In a high-performance Fourier transform (FT) mass spectrometer (MS), the mass-specific oscillating motions of the ions in a magnetic and/or electric fields are detected as image currents induced by the ions in detection electrodes. High-performance mass spectrometry is typically understood in the art to be a technique which typically is capable of achieving mass resolving power of at least 20,000 (using a FWHM—full width at half maximum, definition) and mass accuracy of 20 ppm or better. The entire contents of all references cited below are incorporated herein by reference in their entirety.

There are two major classes of the high-performance FTMS instruments distinguished by the use of either magnetic or electric fields for trapping ions. Currently, Fourier transform electrostatic orbital trap mass spectrometers (FT-OTMS) based on the use of a quadro-logarithmic electric field for trapping ions have gained widespread use in various applications, mostly due to 1) the simplicity of the electric field generation (as compared to the generation of strong magnetic fields) and 2) the lower cost of manufacturing.

In cylindrical coordinates (r,ϕ,z), the ideal quadro-logarithmic electric field potential U(r,z) (sometimes also referred to as a hyper-logarithmic electric field potential) can be described as follows:

$$U(r,z)=\frac{k}{2}\left[z^2-\frac{r^2}{2}\right]+\frac{k}{2}R_m^2\ln\left[\frac{r}{R_m}\right]+C \tag{1}$$

where k is a field strength constant, $R_m>0$ is a characteristic radius, and C is a potential constant.

The motion of an ion having mass m and electric charge q along the axis z in the trapping quadro-logarithmic field ($q\cdot k>0$) is a simple harmonic oscillation near the plane z=0:

$$z(t)=A_z\cos(\omega t+\theta) \tag{2}$$

where t is the time, $A_z$ and θ are the amplitude and the initial phase of the axial oscillation, respectively, and $$\omega=\sqrt{\frac{qk}{m}} \tag{3}$$

is the frequency of axial oscillations.

The ion motion in the polar plane (r,ϕ) in a general case is a complex elliptical rotation around the z axis which is completely decoupled from the ion axial oscillations. When the ellipse is close to a circle of radius R, the ion rotational frequency $\omega_\phi$ is described as (A. Makarov, Anal. Chem, 2000, v. 72, p. 1156-1162):

$$\omega_\varphi=\omega\sqrt{\frac{1}{2}\left[\left(\frac{R_m}{R}\right)^2-1\right]} \tag{4}$$

The ion rotational motion is stable at $R<R_m/\sqrt{2}$ and is unstable at higher rotational radii. The ion kinetic energy $K_\phi$ associated with this rotational motion is independent on mass and can be written as $$K_\varphi=\frac{q^k}{4}(R_m^2-R^2) \tag{5}$$

Ion traps based on the quadro-logarithmic electric field potential and its approximations (usually referred to as Kingdon traps) have been known for a long time (see K. H. Kingdon, Phys. Rev., 1923, v. 21, p. 408-418; R. D. Knight, Appl. Phys. Lett., 1981, v. 38, p. 221-222). A. Makarov was the first who showed their capabilities for use in high-performance mass spectrometry (U.S. Pat. No. 5,886,346). Makarov's orbital trap design (also referred to as Orbitrap) is based on the detection of a current induced on trap electrodes by ion's collective axial oscillations in a virtually ideal quadro-logarithmic electric field followed by frequency analysis of the measured signal (usually by Fourier transform method) to obtain mass spectrum. The Orbitrap mass spectrometer has been commercialized by Thermo Fisher Scientific, Inc.

The main features of a standard Orbitrap are shown in FIG. 1. It consists of a split outer barrel-like electrode and a coaxial inner spindle-like electrode that form an electrostatic field with quadro-logarithmic potential distribution. In all the commercial Orbitraps from Thermo Fisher Scientific, Inc., the characteristic radius $R_m$=22 mm; the maximum inner electrode diameter $R_1$=6-9 mm; the maximum internal radius of the outer electrode $R_2$=15 mm ($R_2\approx R_m/\sqrt{2}$ to make the rotational motion of ions stable inside the trap); and the overall length is about $3\cdot R_2$ or more.

The Orbitrap has a slit (typically 0.1-0.03 mm wide) between outer electrode halves and an injection slot (typically 0.8×5 $mm^2$) in one of the outer electrode halves. The ions are injected as a short bunch (typical bunch duration <1 μs) into the injection slot perpendicularly to the z axis and tangentially to the outer electrode surface with the outer electrodes grounded and the attractive voltage ($V_i$=−3.5-5 kV for positive ions) applied to the inner electrode.

Electrodes of the Orbitrap mass spectrometer create an electric field that is inhomogeneous in two directions, radial and axial. The radial field $E_r$ attracts ions toward the central electrode, this field being stronger near the central electrode. To provide a circular trajectory, the tangential velocity of ions needs to be adjusted to such a value that the centrifugal force compensates the force created by $E_r$. The axial field strength $E_z$ is at zero in the equator plane of the Orbitrap analyzer but increases uniformly in opposing directions along the z axis as the two coaxial electrodes become progressively closer. This means that the axial electric field directs the ions toward the equator of the trap with the force proportional to the distance from the equator. Ions accelerated toward the equator continue to migrate through the equator (point of zero force) along the z axis, but decelerate as they continue toward the opposite end of the Orbitrap expending the axial velocity previously gained in traversing the electric field gradient from the starting point to the equator. Once slowed, the ions are accelerated back toward the equator of the trap by the symmetric electric field along the z axis. In this way, the ions oscillate naturally along the z axis. This oscillation is then combined with a more complicated rotational motion. Due to properties of quadro-logarithmic potential, axial motion is harmonic, i.e. it is completely independent not only of motion around the inner electrode but its frequency is independent also on all initial parameters of ions except their mass-to-charge ratios m/q.

To increase the mass range of the trapped ions, the attractive voltage during ion injection is ramped from about $0.75 \cdot V_i$ to the maximum $V_i$ for 20-100 μs (so called electrodynamic squeezing trapping method). The injected ions do not require any additional excitation to start axial oscillations as the ions are injected away from the equatorial plane z=0 so they start oscillation as a cloud immediately after the injection with an amplitude $A_z \approx 7$ mm. The ion oscillatory motion is detected by measuring the current induced on two halves of the trap outer electrode. The current is amplified, digitized and frequency-analyzed (typically using Fourier transform method) to obtain the mass spectrum.

According to equations (2) and (3), in the ideal quadro-logarithmic field, ions perform simple harmonic oscillations along the z axis with frequencies that depend on the ion's m/q ratio only which is the basis for ion mass measurement in FT-OTMS with very high mass resolution and accuracy. In practical Orbitrap instruments (as it was indicated by A. Makarov et al. in U.S. Pat. No. 7,714,283), because of slight deviations of the field inside the trap from the ideal quadro-logarithmic potential, these frequencies also slightly depend on the amplitude of the ion axial oscillation.

As a result, the phases of oscillations for separate ions are spread out over the time and the coherent motion of the initially tight ion cloud disappears with time that limits the instrument mass resolution and accuracy. As it was pointed out in U.S. Pat. No. 7,714,283, this problem of loss of coherent motion is due to imperfection of the electric field inside the trap because of limited manufacturing tolerances and non-ideal approximation of the quadro-logarithmic potential by the electrode geometry used. Over time the accuracy of electrode manufacturing improved, and the manufacturing tolerances are presently within a few microns. In addition, many of the mechanical imperfections have diminished due to averaging feature of ion rotational and oscillating motions.

SUMMARY OF THE INVENTION

In one embodiment of the present invention, there is provided an orbital ion trap for electrostatic field ion trapping which includes an electrode structure defining an internal volume of the trap with at least some of electrode surfaces shaped to substantially follow equipotential lines of an ideal quadro-logarithmic electric potential around a longitudinal axis z. The ideal electric potential has an inner potential canyon, an outer potential canyon, and a low potential passage therebetween. The trap includes a trapping voltage supply which provides trapping voltages on the electrodes to generate a trapping electrostatic potential within the internal volume of the trap. The trapping electrostatic potential closely approximates at least a part of the ideal electric potential in at least a part of the internal volume of the trap. The approximated part of the ideal electric potential includes the low potential passage between the inner and outer potential canyons of the ideal electric potential and at least a part of the inner potential canyon adjacent to the passage.

In one embodiment of the present invention, there is provided a mass spectrometer equipped with the above-noted orbital ion trap.

In one embodiment of the present invention, there is provided a method for detecting ions using the above-noted orbital ion trap.

It is to be understood that both the foregoing general description of the invention and the following detailed description are exemplary, but are not restrictive of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6A is a 3-D representation of the quadro-logarithmic electric field potential in cylindrical coordinates (r,z) showing inner and outer potential canyons and a passage in between;

DETAILED DESCRIPTION OF THE INVENTION

This invention addresses various problems in conventional high-performance mass spectrometers utilizing electrostatic orbital trap (OT) mass spectrometers (MS). For example, the effect of non-ideal approximation of the quadro-logarithmic potential in electrostatic orbital traps has been analyzed by Makarov et al. in U.S. Pat. No. 7,714,283. The truncation of the electrodes beyond some points along z axis has been shown to have relatively limited effect upon the ion phase spread discussed above. In particular, the shape of the trap near the electrode ends over the last 10% of its length (near the electrode ends) is largely irrelevant and according to Makarov there is no need to provide compensation (using extra electrodes) for the truncation of the inner and outer trap electrodes relative to their ideal infinite extent.

However, there are other features of the standard orbital trap (see FIG. 1) such as the injection slot and (to a lesser extent) the central slit between the split outer electrode halves that do negatively affect the field inside the trap and strongly contribute to the phase spread of ion oscillations along the central z axis.

To counter this negative effect, Makarov et al. suggested in U.S. Pat. No. 7,714,283 introducing a compensating non-linear perturbation to the potential inside the trap by means of deviating the shape of at least part of the inner and outer electrodes from the ideal quadro-logarithmic field equipotential, by stretching the outer electrode in the axial direction, by compressing the inner electrode in the radial direction, by using additional spacer electrodes, or by segmenting the outer or inner electrodes into multiple sections. While facilitating a solution of the ion phase spread problem, the inventors of this application have found that these approaches bring more problems to the OTMS design (due to the increased complexity of the orbital trap electrode structure) and operation (due to unpredictable effect of such modifications on interaction of the ion radial motion with the axial oscillations at different radii).

Figure 2:
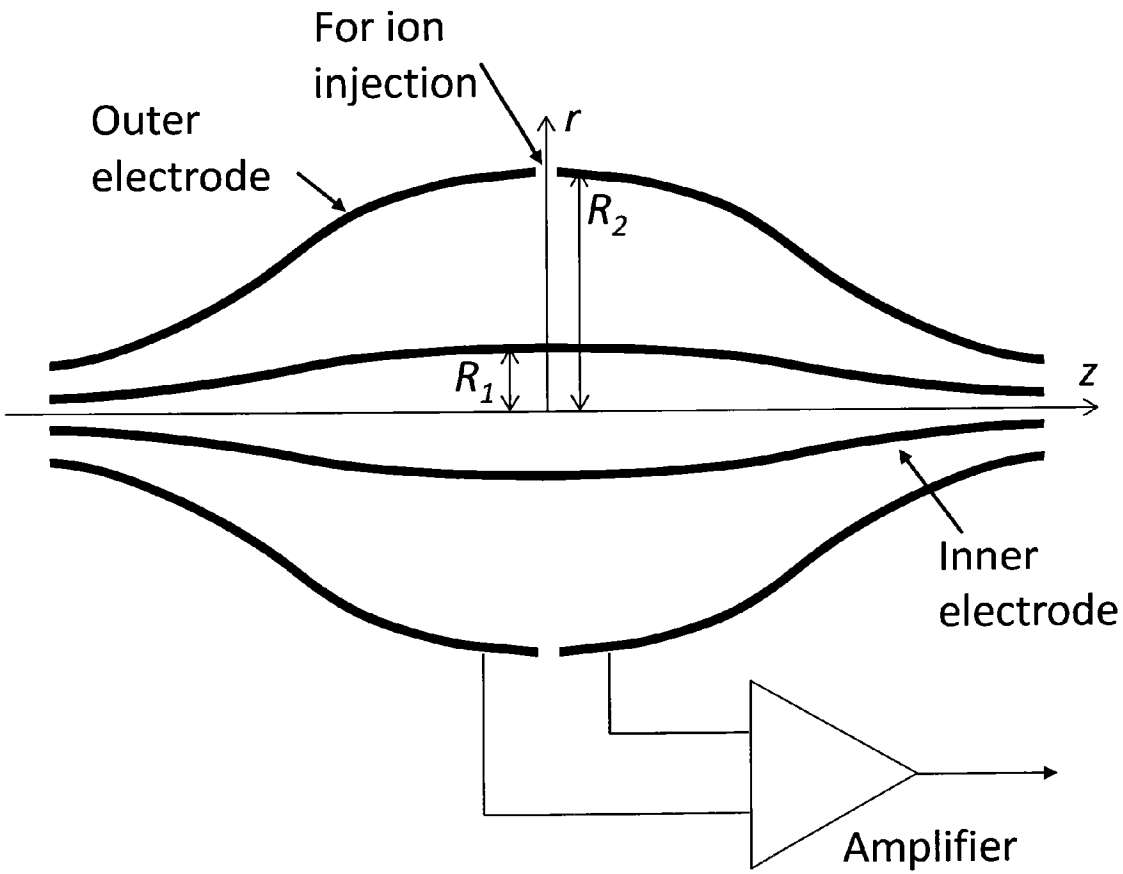
FIG. 2 Background Art
FIG. 2 is a schematic representation of another available orbital trap design with injection of ions in an equatorial plane (background art)

In another OTMS design proposed by Makarov in U.S. Pat. No. 5,886,346, the ions are injected through the central slit between the outer electrode halves as shown in FIG. 2 followed by ion excitation in the z direction by application of the excitation voltage to either the outer electrode halves (so called dipole excitation) or the inner electrode (quadrupolar parametric excitation).

Figure 1:
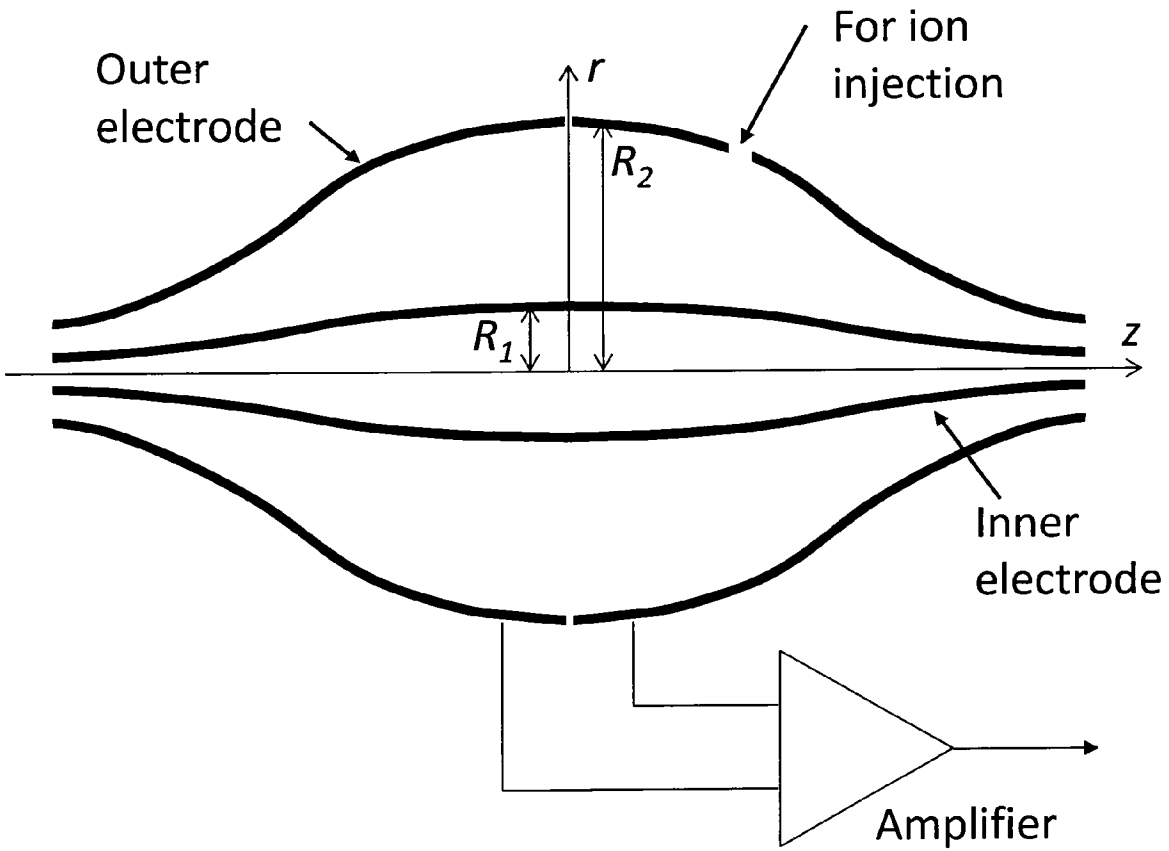
FIG. 1 Background Art
FIG. 1 is a schematic representation of commercial Orbitrap design and scheme for ion injection and detection of ion motion (background art)

The electrode structure geometry in this design still follows that shown in FIG. 1. To inject the ions through the central slit, the width of the slit should be much larger compared to the design shown in FIG. 1 and can reach 0.5-1 mm. The inventors of this application have found that the distortions to the field inside the trap created by the larger gap will inevitably affect the coherent motion of the ion cloud along the z axis resulting in a quick loss of the detected signal, thus leading to poor mass resolution.

The present inventors have observed that the ion injection schemes used in prior art OTMS designs create severe electric field distortions in the area of ion motion inside the trap resulting in phase spread of ion oscillations and loss of coherent motion of ions along the z axis. Currently available solutions require the use of complicated electrode modifications from the ideal electrode structure geometry to address this problem.

There is a clear need for the solution of the ion phase spread problem in an orbital ion trap without introducing perturbation fields into the ion trap design and/or without compromising on simplicity of the ideal electrodes shaped along the equipotential lines of the ideal quadro-logarithmic electric field.

Figure 3:
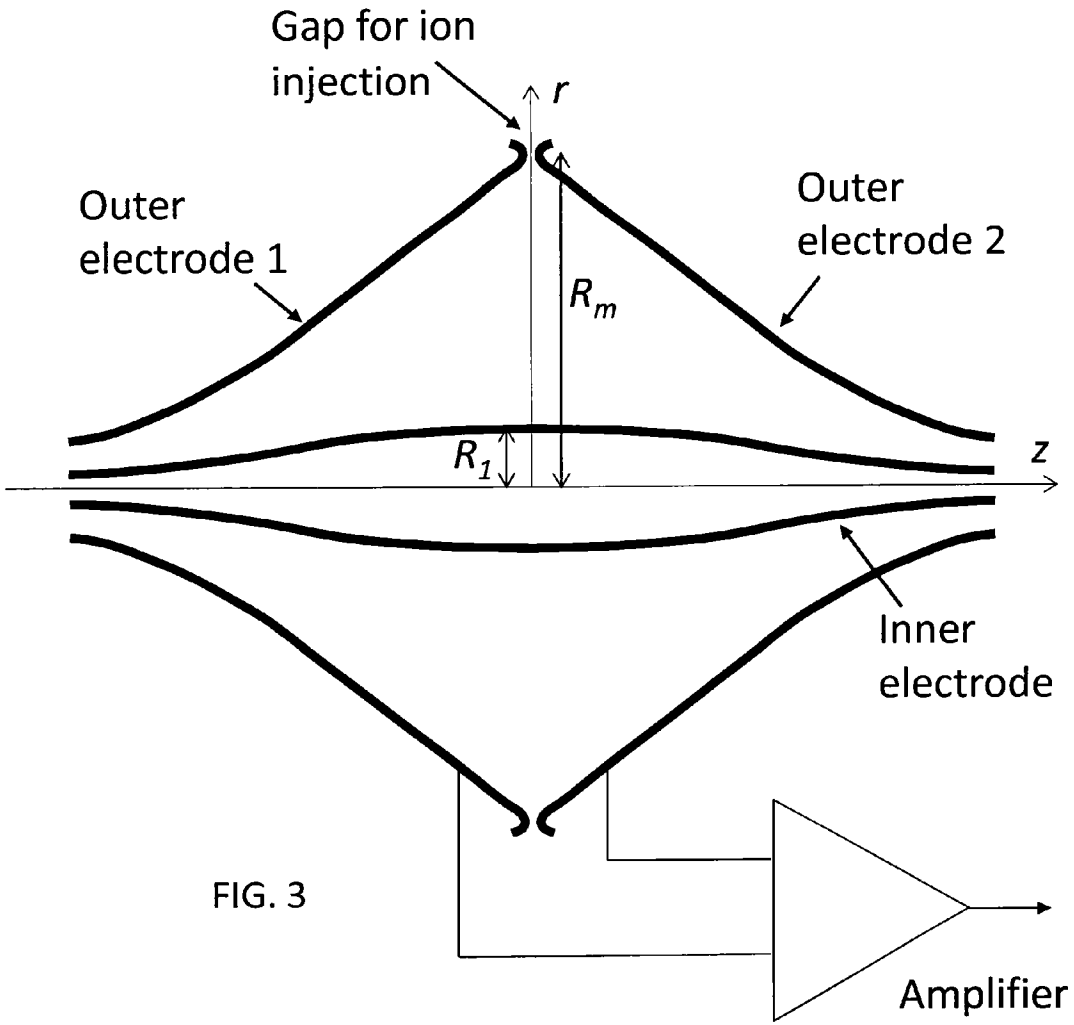
FIG. 3 is a schematic representation of the inventive orbital trap design with injection of ions through a natural gap including a passage between potential canyons in an equatorial plane.
Figure 4:
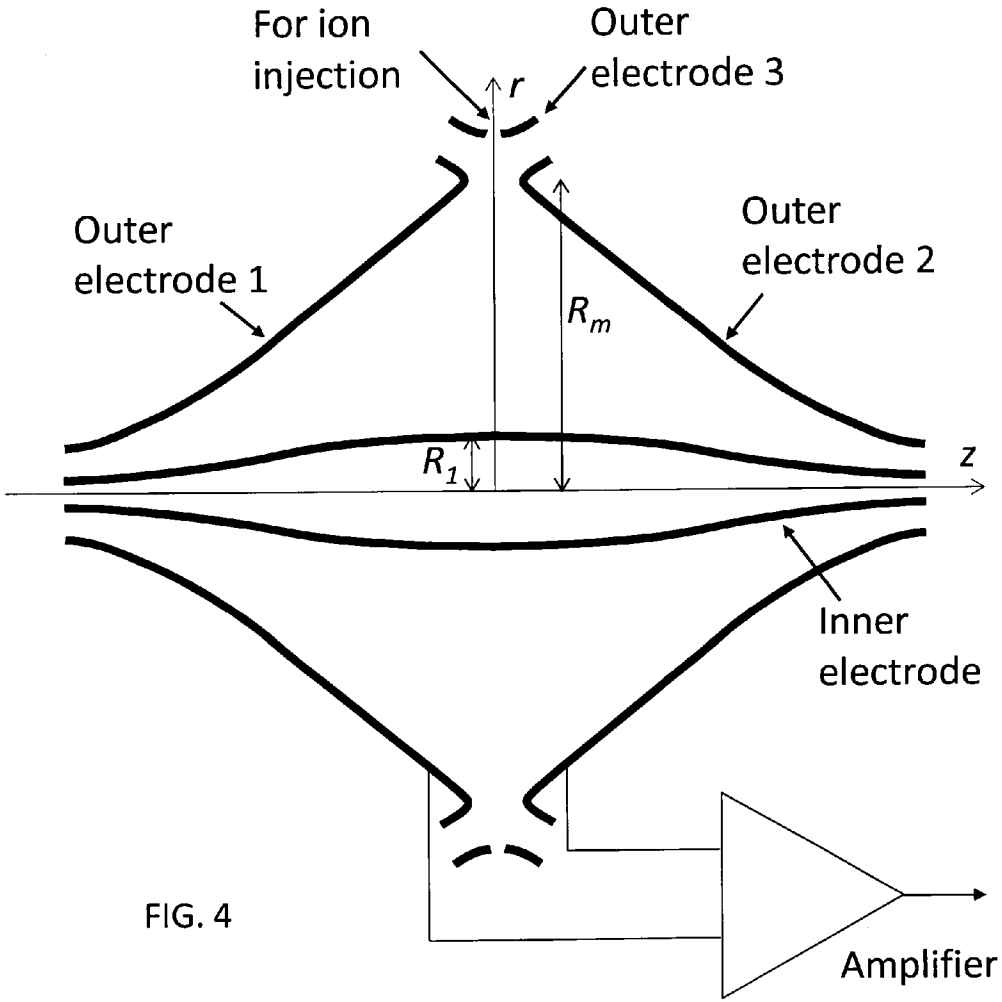
FIG. 4 is a schematic representation of another inventive orbital trap design with injection of ions through the natural gap in an equatorial plane wherein an additional electrode is used to compensate the effect the radial truncation of the electrodes on the field inside the gap.

FIGS. 3 and 4 are cross sections of the traps having axial rotational symmetry. The outer surface of the spindle electrode 1 and inner surfaces of the cap electrodes 2 and 3 are at the same (but different for different electrodes) potentials (equal to voltages applied to them). Because these surfaces correspond to solutions of the quadro-logarithmic potential (1) for the same potentials (hence, the term "equi-potential"), then according to Laplace equation the electric field between these surfaces is also quadro-logarithmic.

The present invention addresses the problem of ion injection into the electrostatic orbital trap without creating perturbations in the ideal quadro-logarithmic electric field. In the inventive design, a simple geometry of the trap electrodes produces the electric field which follow closely the ideal quadro-logarithmic electric field.

As used herein, an "ideal quadro-logarithmic electric field potential" means the potential described by equation (1).

As used herein, "to follow closely an ideal quadro-logarithmic electric field potential" means to follow the potential as described by equation (1) with as minimal purtubations as possible (in the art).

After introducing dimensionless coordinates $\bar{r}=r/R_m$, $\bar{z}=z/R_m$ and potential $\bar{U}=U/(kR_m^2)$ the quadro-logarithmic electric field potential (1) can be rewritten as $$\bar{U}(\bar{r},\bar{z})=\frac{1}{2}\left(\bar{z}^2-\frac{\bar{r}^2}{2}\right)+\frac{1}{2}\ln\bar{r}+\frac{1}{4} \tag{6}$$

where the potential constant C was selected to satisfy the condition $\bar{U}(1,0)=0$.

Figure 6A:
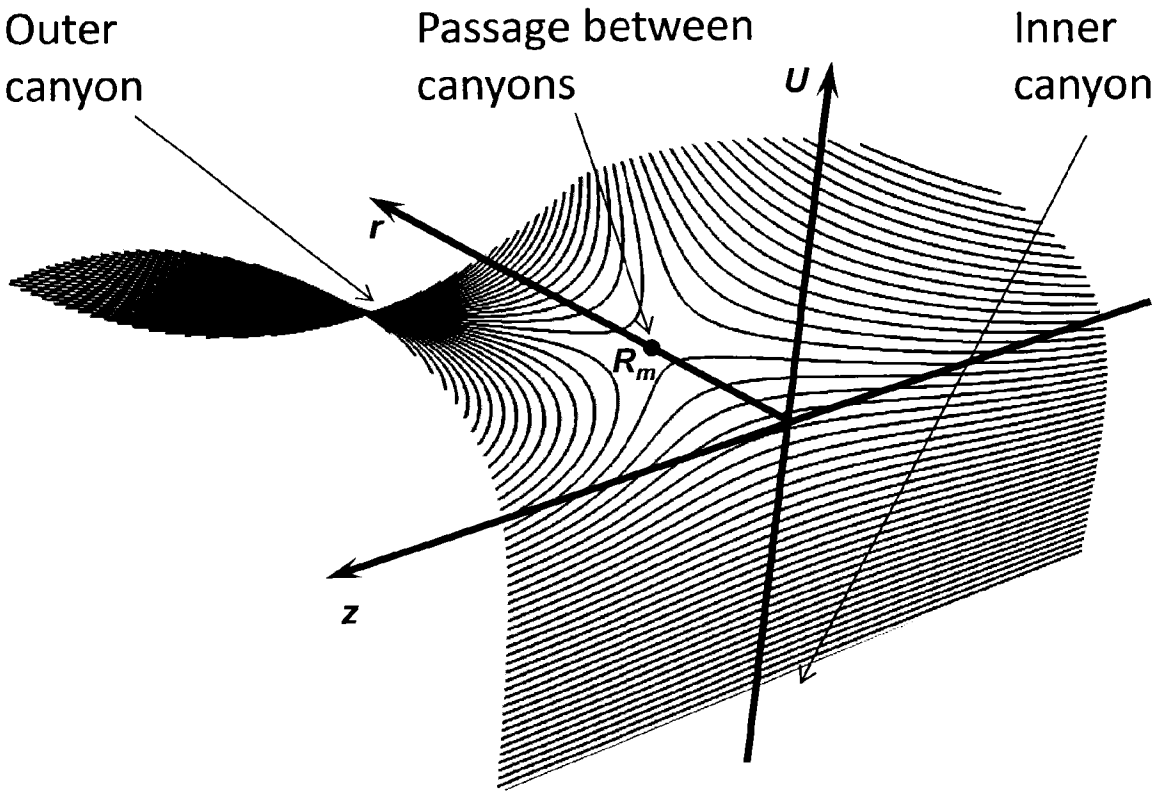

The dependence of $\bar{U}$ upon coordinates $\bar{r}$ and $\bar{z}$ is shown as a 3-D plot in FIG. 6A. The main features of this potential plot are two deep canyons at the regions of small $\bar{r}<1$ (an inner potential canyon) and large $\bar{r}>1$ (an outer potential canyon). The plot 3-D plot in FIG. 6A represents a surface where the lines of the same potentials (equipotential lines) are shown. The surface falls down before the passage (an inner canyon close to z axis, at $r<R_m$) and behind the passage (an outer canyon, at $r>R_m$). These two potential canyons are connected in the equatorial plane $\bar{z}=0$ by a passage at $\bar{r}=1$ (the dimensionless potential is normalized to be 0 at this passage point). Thus, the characteristic radius $R_m$ defines the position of the inner ($r<R_m$) and outer ($r>R_m$) canyons as well as the passage between them.

The equipotential surfaces of orbital trap electrodes can be found from potential (6) as a solution of the equation (7):

$$\bar{U}_i^{el}=\bar{U}(\bar{r},\bar{z}) \tag{7}$$

where $\bar{U}_i^{el}$ is a potential on the i-th electrode. For each $\bar{U}_i^{el}<0$ there are two solutions of equation (7) typically corresponding to surfaces in the inner ($\bar{r}<1$) and outer ($\bar{r}>1$) canyons, and only the inner canyon surface is used in the standard Orbitrap electrode design.

In addition, a standard Orbitrap trap utilizes only a part of the area of the inner canyon (corresponding to $\bar{r}<1/\sqrt{2}$ at the equatorial plane or $\bar{U}_i^{el}<-0.04829$). The rest of the inner canyon (as well as the outer canyon area) are not used, as the rotational motion of ions was shown to be unstable there (see A. Makarov, Anal. Chem, 2000, v. 72, p. 1156-1162). The potentials $\bar{U}_i^{ei}$ in the standard Orbitrap ($R_m$=22 mm) are: for the inner electrode (i=1; $R_1$=6 mm) $\bar{U}_1^{el}=\bar{U}(R_1/R_m,0)=-0.4182$; for the outer electrode (i=2; $R_2$=15 mm)$=\bar{U}_2^{el}=\bar{U}(R_2/R_m,0)=-0.0577$.

In the inventive design the used volume of the quadro-logarithmic electric field includes a whole inner canyon (including the $$\frac{1}{\sqrt{2}} < \bar{r} < 1$$

$<\bar{r}<1$ area) up to the passage point ($\bar{r}=1$) and in some cases even some area of the outer canyon beyond the passage ($\bar{r}>1$). In terms of equation (7), this corresponds to using equipotential surfaces for the outer electrode with the potential $\bar{U}_2^{el}>0$. At $\bar{U}_2^{el}>0$, the solution of equation (7) consists of two surfaces positioned symmetrically relatively the equatorial plane z=0 that are separated by a gap $\bar{\Delta}$ at $\bar{r}=1$:

$$\bar{\Delta} = 2|\bar{z}_{(\bar{r}=1)}| = 2\sqrt{2\bar{U}_2^{\theta 2}} \tag{8}$$

where $\bar{z}_{(\bar{r}=1)}$ is a solution of equation (7) at $\bar{r}=1$.

Accordingly, in one embodiment of this invention (shown in FIG. 3), the trap electrode structure includes two outer electrodes symmetrically located near the equatorial plane with a natural gap between the outer electrodes which can be used for injection of ions into the trap (not a single outer electrode with a slit after cutting it into two halves or a slot in one of the halves as in the standard Orbitrap design). This "natural gap" in the inventive design is positioned at a place where a part of the quadro-logarithmic electric field corresponds to the passage between its inner and outer canyons so the presence of the gap in the inventive design does not disturb the field inside the trap if the gap is small enough compared to the characteristic radius $R_m$ (typically, less than 2-5% of $R_m$). The electrode geometry (shape) is designed to satisfy equipotential solutions of equation (7).

Accordingly, as noted above, the orbital ion trap includes an electrode structure defining an internal volume of the trap with at least some of electrode surfaces shaped to substantially follow equipotential lines of an ideal quadro-logarithmic electric potential around a longitudinal axis z. The ideal electric potential (as shown in FIG. 6A) has an inner potential canyon, an outer potential canyon, and a low potential passage therebetween. The trap includes a trapping voltage supply which provides trapping voltages on the electrodes to generate a trapping electrostatic potential within the internal volume of the trap. The trapping electrostatic potential closely approximates at least a part of the ideal electric potential in at least a part of the internal volume of the trap. The approximated part of the ideal electric potential includes the low potential passage between the inner and outer potential canyons of the ideal electric potential and at least a part of the inner potential canyon adjacent to the passage.

In practice, the fabricated electrodes do not conform to a "perfect shape." Some degree of variation is expected from normal fabrication tolerances. Moreover, in various embodiments of the invention, the shape of the electrodes can deviate from a shape which would yield the ideal quadro-logarithmic potentials. Deviations in the electrode shape from the "ideal" shape can include segments in the electrode shape having less than a 10 μm or less dimensional offset (typical for current electrode machining) from the shape of an ideal segment in that position of the orbital trap.

Figure 6B:
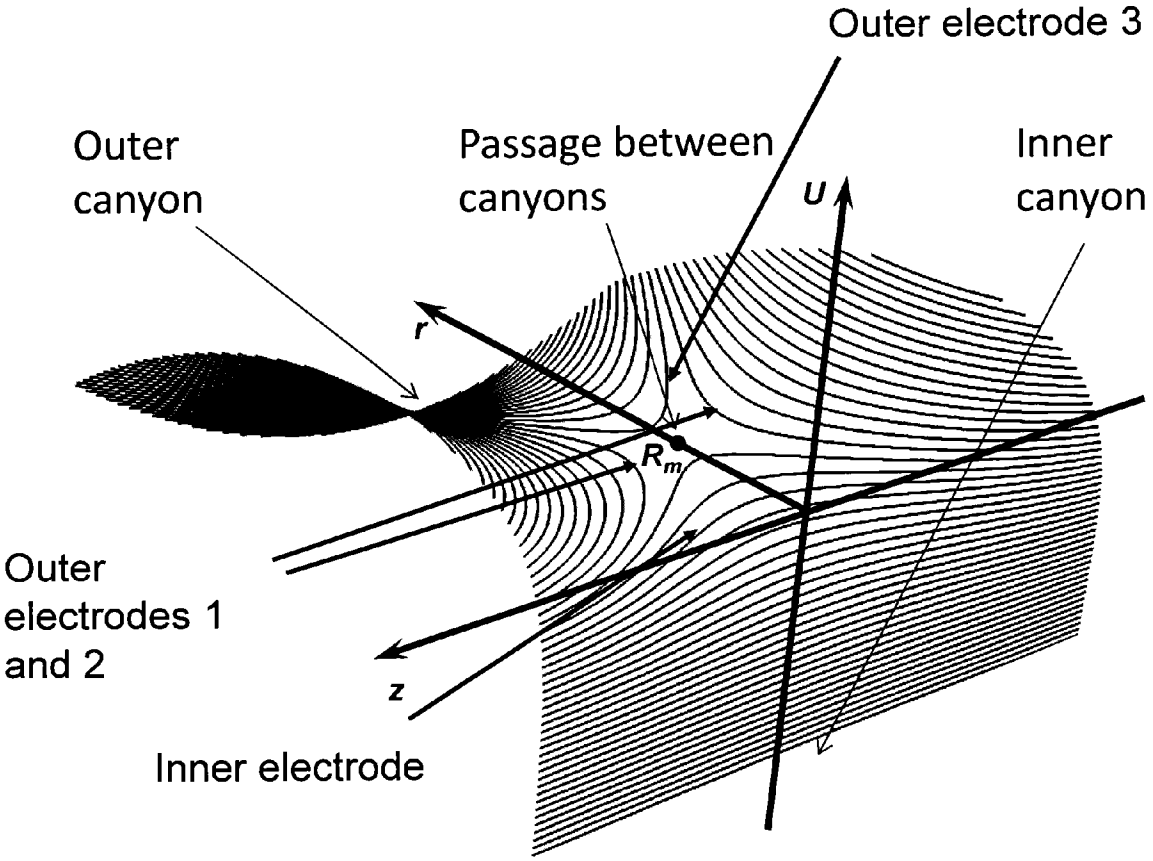
FIG. 6B is a marked up representation of the quadro-logarithmic electric field potential shown in FIG. 6A including schematic designation of the location and shape of the respective inner and outer electrodes shown in FIGS. 3 and 4.

Even with the deviations, the electrode shape (upon application of an electrostatic potential) would develop the above noted trapping electrostatic potential which closely approximates at least a part of the ideal electric potential in at least a part of the internal volume of the trap. Even with the deviations, the approximated part of the ideal electric potential would include the low potential passage between the inner and outer potential canyons of the ideal electric potential and at least a part of the inner potential canyon adjacent to the passage, as illustrated schematically in FIG. 6B. FIG. 6B is a marked up representation of the quadro-logarithmic electric field potential shown in FIG. 6A including designation of the location and shape of the respective inner and outer electrodes shown in FIGS. 3 and 4. Here as shown in FIG. 6B, in one embodiment of the invention, the outer electrodes 1 and 2 have surfaces facing the inner trap which are hyperbolically-shaped or otherwise are a close approximation of a quadro-logarithmic potential in a vicinity of the low potential passage and include the inner potential canyon adjacent to the low potential passage.

In one embodiment of this invention, if the gap between the two outer electrodes 1 and 2 is large (typically, more than 5 percent of $R_m$), then one more central outer electrode (an outer electrode 3 in FIG. 6B) located in the outer canyon area may be utilized (as shown in FIG. 4) to make the potential in the passage gap area close to that in the ideal quadro-logarithmic potential. This third outer electrode is also generally a solution of equation (7) using $\bar{U}_3^{el}<0$ (typically $\bar{U}_3^{el}=-0.02$ can be used), but from two solutions of (7) for $\bar{U}_3^{ei}$ the one corresponding to the outer canyon ($\bar{r}>1$) is selected in this case. The third electrode typically has a slit (typically 0.4-1.5 mm) to inject ions into the internal volume of the trap (through the gap between the outer electrodes 1 and 2). As the third electrode is well shielded by the passage, the effect of the presence of this slit on the potential in the inner canyon area is negligible.

The "extra" inner canyon volume (corresponding to $$\left(\text{corresponding to } \frac{1}{\sqrt{2}} < \bar{r} < 1\right)$$

$<\bar{r}<1$) and the passage between two canyons included in the inventive design produces a natural gap for introduction of ions into the trap that does not make perturbations into the field inside the trap (while in the standard Orbitrap design the injection slot and the split outer electrode introduce perturbations into otherwise ideal quadro-logarithmic electric field inside the trap). Thus, in the inventive design, the "ideal" electrode structure shape does not have to be distorted to "compensate" those perturbations.

In one embodiment of this invention, by applying an attractive electric voltage to the trap inner electrode, one can generate the field inside the trap which in the volume corresponding to $\bar{r}<1/\sqrt{2}$ will be similar to that in the standard Orbitrap design, and only this volume will be mostly used for trapping ions in the inventive design (as ion's rotational motion is stable in this area). The rest of the trap's internal volume including the passage area will be used during ion injection only. The passage provides a convenient (and natural) gap for ion injection from outside the trap.

In one embodiment of this invention, the passage gap is located substantially farther from the area of stable ion motion (compared to the locations of the injection slot or the slit between outer electrode halves in the standard Orbitrap), and for this reason its effect on the ion axial motion typically becomes negligible even in the design without the third outer electrode (FIG. 3).

Figure 5:
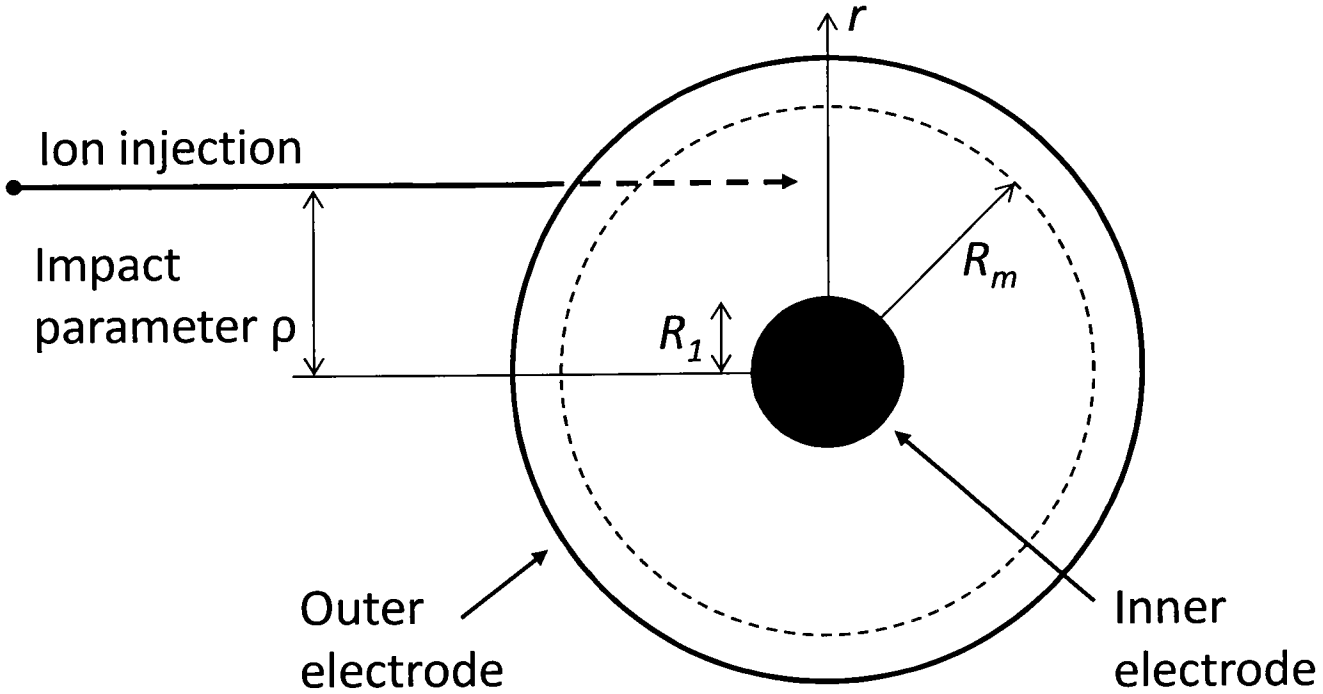
FIG. 5 is a schematic representation of ion injection at equatorial (z=0) plane into the trap inner volume used in the inventive orbital trap designs shown in FIGS. 3 and 4.

To prove possibility of ion injection into the inventive orbital trap (and to compare the inventive orbital trap with injection into a standard Orbitrap), the inventors conducted numerical simulations of the injection process using an industry-standard SIMION® software package. In both trap designs, the characteristic radius $R_m$=22 mm and the maximum inner electrode radius $R_1$=6 mm were used. In the Orbitrap, the maximum internal radius of the outer electrode $R_2$=15 mm. In both cases, the beam of ion having mass-to-charge ratio m/z=500 was injected in the trap equatorial plane perpendicular to the z axis at different injection impact parameters ρ (which is the shortest distance from the injection line to the trap z axis as shown in FIG. 5). The attractive voltage $V_i$ on the inner electrode during the ion injection is ramped from about $0.66 \cdot V_i$ to the maximum $V_i$ for 30-40 μs to trap ions using the electrodynamic squeezing trapping method ($V_i$ is set to −3.5 kV in both cases).

Figure 7A:
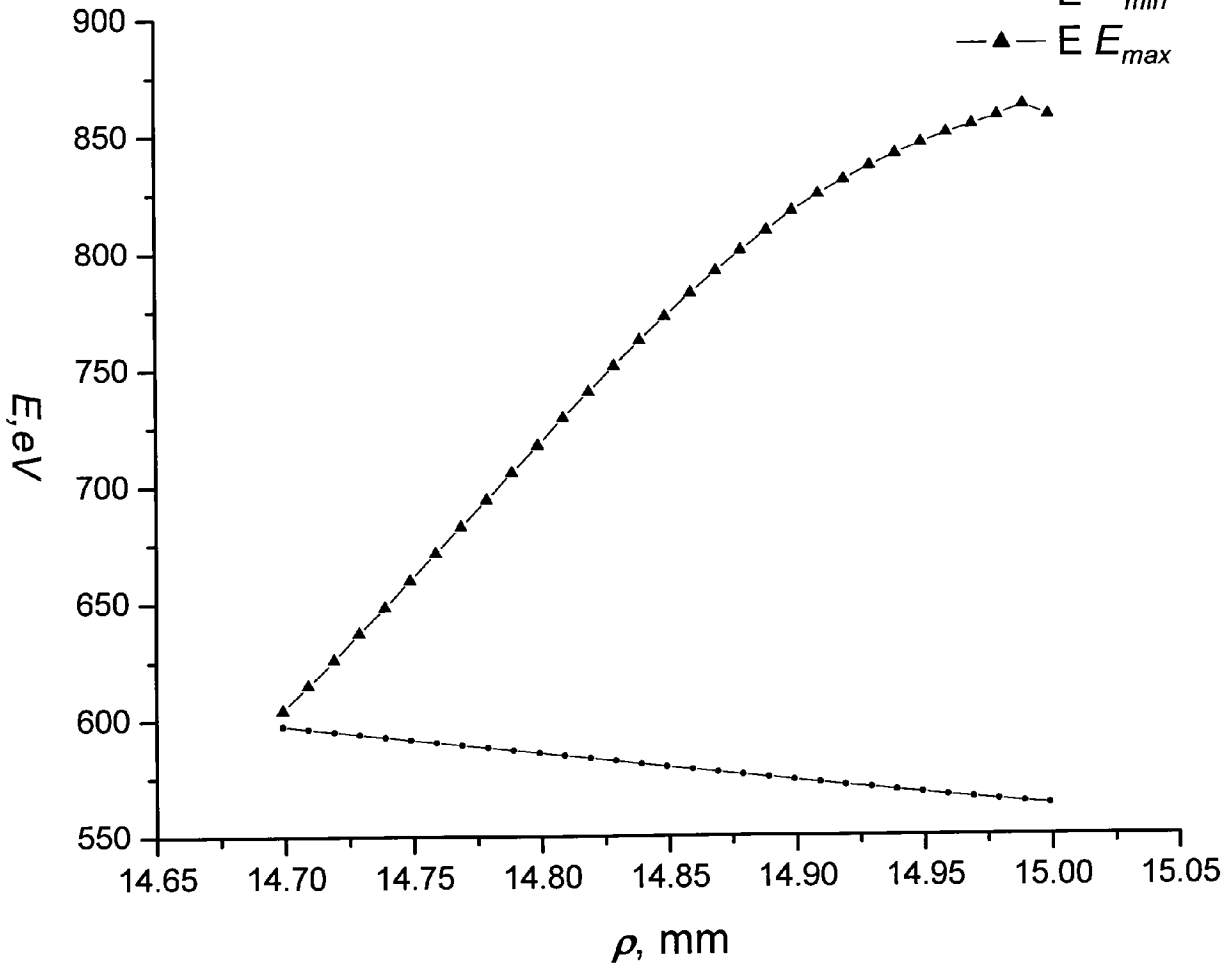
FIGS. 7A and 7B are graphs showing the calculated lowest (lines with solid circle data) and highest (lines with solid triangle data) energies at which the injected ions are trapped for the given impact parameter in the standard Orbitrap (A) and inventive orbital trap (B) designs.
Figure 7B:
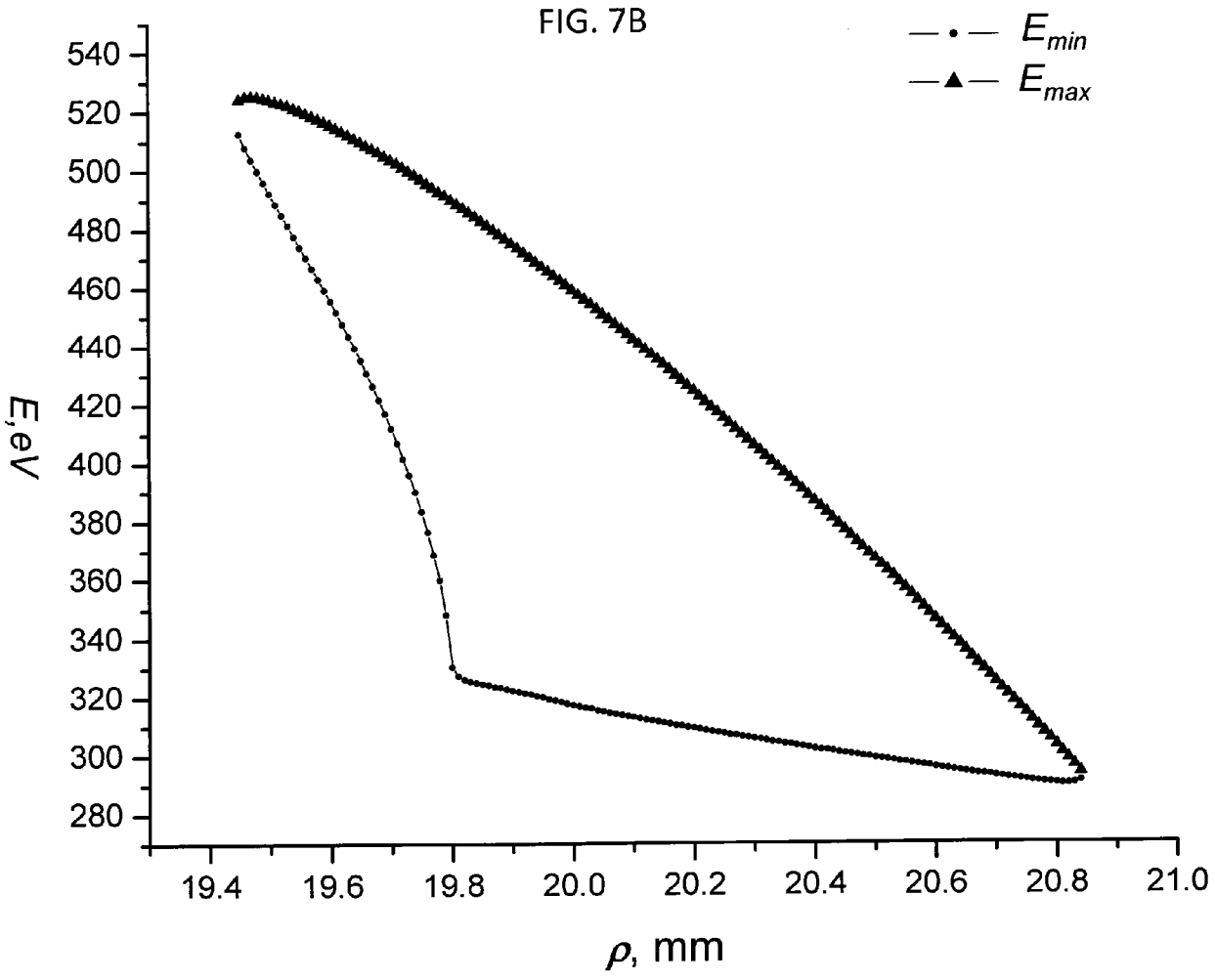

In the simulations, the energy of ions was varied at different impact parameters to determine values of the lowest and the highest energies at which the ions could be trapped. The results presented on an "Ion energy E"–"Impact parameter ρ" diagram are shown as two curves corresponding to the dependences of the lowest and the highest energies at which ions are trapped upon the impact parameter (see FIGS. 7A and 7B). The triangle data lines in FIGS. 7A and 7B correspond to the highest initial kinetic energy when the injected ion is still trapped. The circle data lines correspond to the lowest energy for trapping ions. The area between the triangle and circle lines includes the parameters acceptable for ion trapping.

For a typical case of energy intervals of 10 eV, the acceptable interval for the impact parameter is larger in the inventive trap design compared to that of the standard Orbitrap (0.8 mm vs. 0.3 mm, respectively). In both cases, the acceptable energy interval can be large (e.g., it can be more than 100 eV).

The major difference between both cases is in the acceptable intervals for the impact parameter. Typically, the ion energy in an experiment can be well controlled (at least within 1-10 eV). For typical case of energy intervals of 10 eV, the acceptable interval for the impact parameter ρ is less than 0.3 mm in the case of Orbitrap and 0.8 mm as one example of the inventive trap. This means that, in the inventive design, the ion beam can be several times (e.g., 2 to 4 times) wider as compared to that in the Orbitrap. This is important as the focusing of ion beams into a tight diameter can be problematic, especially at ion energies less than 1 keV. The larger acceptable interval for the impact parameter in the inventive design is a clear advantage of the inventive trap design (in addition to providing the ideal quadro-logarithmic electric field inside the trap). Also, the use of wider ion beams can result in similar order sensitivity gain in the inventive trap.

Figure 8:
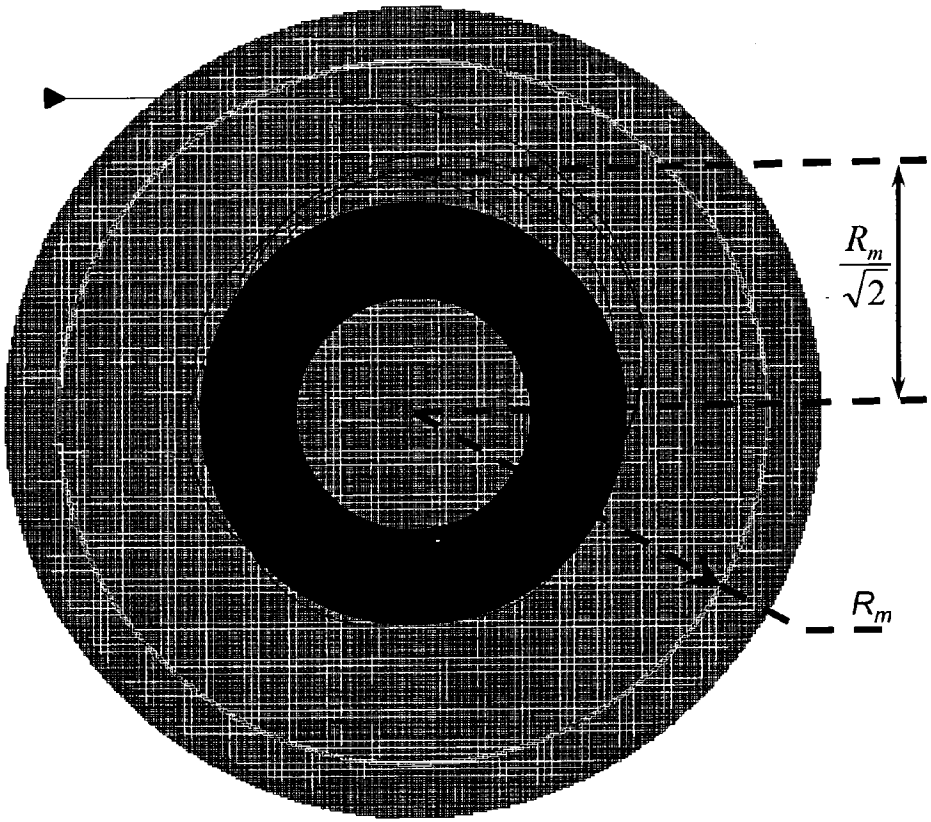
FIG. 8 is a SIMION trajectory representation for an ion injected and trapped in the inventive orbital ion trap showing the ion capture at orbital radii less than $R_m/\sqrt{2}$.

As expected, due to the instability of the rotational motion the ions in the inventive trap similarly to that in the Orbitrap are trapped at radii $\bar{r}<1/\sqrt{2}$. This is illustrated by a SIMION trajectory picture for the ion injected and captured in the inventive orbital trap in FIG. 8. What was not expected is that range of the acceptance parameters in the inventive design was comparable to or better than that in the Orbitrap despite of the fact that the potential at the trapping radius ($\bar{r}<1/\sqrt{2}$) is lower relatively the potential at the start point of the injection trajectory (they are about the same in the Orbitrap case). This at first glance contradictive result can be explained by the following non-limiting description. The radial dependence of the total rotational energy of an ion $E_\Phi=K_\Phi+qU$ can be taken into account by writing equations (5) and (6) for the z=0 plane where all injections take place, in a dimensionless form $\bar{E}_\Phi=E_\Phi/(qkR_m^2)$ as $$\bar{E}_\Phi(\bar{r},0)=\tfrac{1}{2}(1-\bar{r}^2)+\tfrac{1}{2}lm\bar{r} \tag{9}$$

Figure 9:
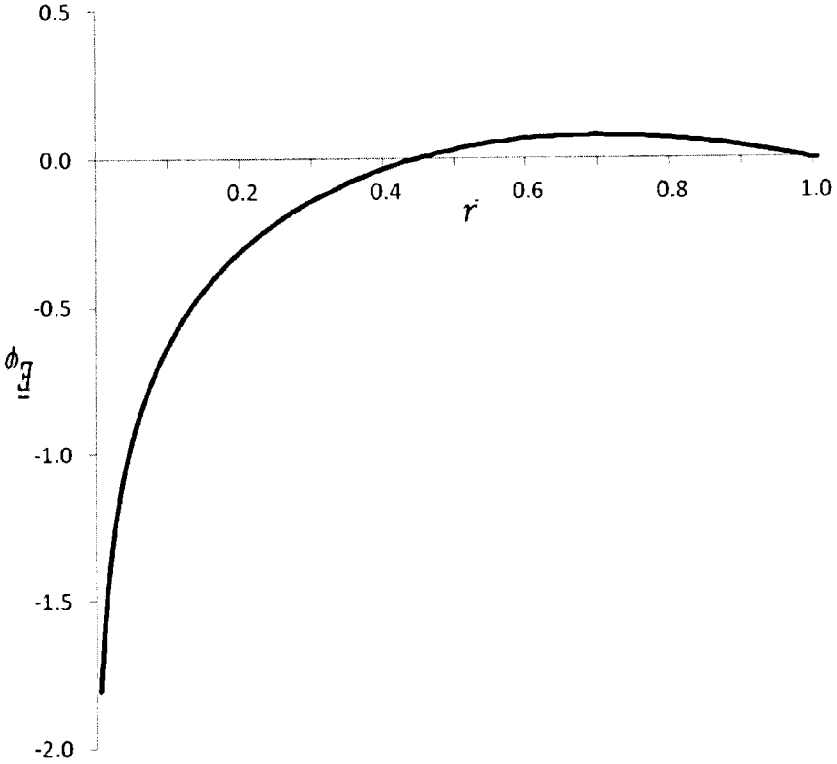
FIG. 9 is a graph showing the dependence of the total energy of an ion in the inventive trap design upon the rotational radius.

This dependence is shown in FIG. 9.

One unique feature of this dependence discovered by the inventors which is not observed in any rotational motion in 3-D potential fields (around a point charge) is a presence of a barrier with a maximum at $\bar{r}=1/\sqrt{2}$. The position of this maximum at $\bar{r}=1/\sqrt{2}$ is a physical reason of ion rotational instability at $\bar{r}>1/\sqrt{2}$. At the same time as the total ion's energy at infinity is lower than that at $\bar{r}=1/\sqrt{2}$, it needs an additional energy to reach areas with $\bar{r}<1/\sqrt{2}$ where the rotational motion is stable (as compared to losing the total energy required for particle capture in the 3-D field around a point charge).

Thus, the ion trapping process in the inventive trap is similar to that in the standard Orbitrap, and the area $$\frac{1}{\sqrt{2}} < \bar{r} < 1$$

$<\bar{r}<1$ is effectively acts as an electrooptical lens directing ions to the inner area $\bar{r}<1/\sqrt{2}$.

One benefit of the inventive trap is in the use of the natural gap near the passage between the potential canyons for ion injection instead of using a slot cut in the Orbitrap wall, perturbing the field inside the trap. As a result in the inventive design, the "ideal" electrode structure shape does not have to be altered to "compensate" those perturbations.

In various embodiments of this invention, the inventive orbital trap can be used in an orbital trap mass spectrometer including a high-performance Fourier transform orbital trap mass spectrometer in a way similar to that described in prior art (see, for example: U.S. Pat. No. 5,886,346; U.S. Pat. No. 6,872,938; A. Makarov, Anal. Chem, 2000, v. 72, p. 1156-1162; Q. Hu, R. J. Noll, H. Li, A. Makarov, M. Hardman, R. G. Cooks, J. Mass Spectrom., 2005, v. 40, p. 430-443). The inventive orbital traps of the types shown in FIG. 3 or FIG. 4 used in the embodiments below typically have the following parameters: $R_m$=15-50 mm (preferably $R_m$=22 mm); $R_1=(0.2-0.45)\cdot R_m$ (preferably $R_1$=6 mm); the trap length along the z axis is $(2-3)\cdot R_m$ or larger (preferably 50 mm); the gap width in the trap passage area $\Delta=(2-6)\cdot 10^{-2}R_m$ (preferably Δ=0.88 mm which corresponds to the parameter in equation (7) $\bar{U}_2^{ei}=+2\cdot 10^{-4}$).

The first orbital trap mass spectrometer embodiment (see FIG. 10) utilizes an external ion storage device for accumulating ions before injecting them into the inventive orbital trap. The sample ions from an ion source which typically is located at atmospheric pressure (AP) conditions (so called AP ion sources, like electrospray ionization—ESI, AP matrix-assisted laser desorption/ionization—AP-MALDI, AP chemical ionization—APCI, secondary ESI—sESI, AP photoionization—APPI, etc.) enter the vacuum of the mass spectrometer using an atmospheric pressure interface (API) typically consisting of a heated inlet capillary and one or more ion guides located in differentially pumped vacuum sections separated by gas conductance limits/orifices so increasingly better vacuum is achieved downstream of the ion beam.

Also, in various embodiments of this invention, in addition to AP ion sources, the inventive orbital trap can be used in an orbital trap mass spectrometer including internal (vacuum-based) ion sources, like electron impact (EI) or low pressure CI sources. Typically, an ion guide is built from four, six, or eight parallel rod electrodes positioned around an ion guide axis (quadrupole, hexapole, or octopole ion guides, respectively), but the ion guide can be also designed from an array of ring electrodes too with RF voltages of opposite phases applied to the neighboring electrodes. The electric field set inside the ion guide typically encourages ions to move downstream along the ion guide axis by setting proper DC voltages on entrance and exit end electrodes of the ion guide as well as setting DC bias voltage on the RF electrodes. In addition, the ion guides can be sectioned with each section having a separate DC bias voltage to drive ions through the ion guide.

Figure 10:
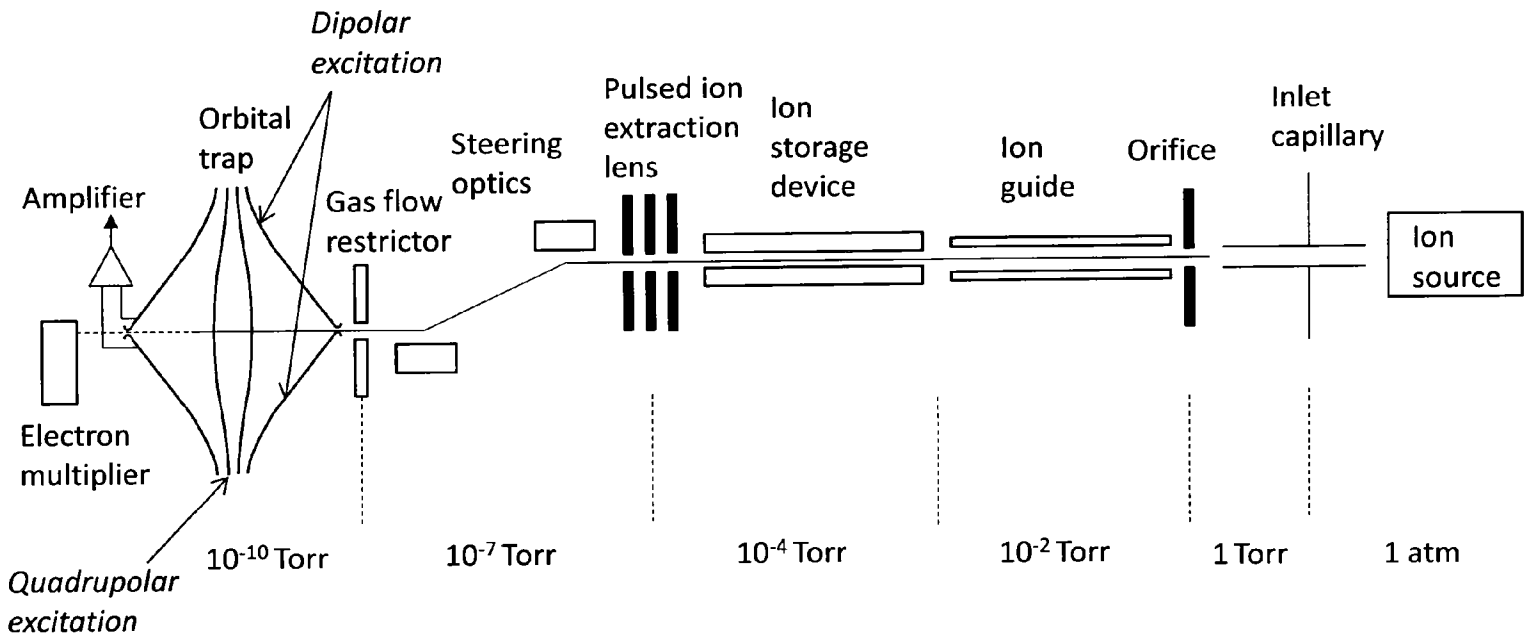
FIG. 10 is a schematic representation of one embodiment of a mass spectrometer based on the inventive orbital ion trap design utilizing an external storage device for injecting ions into the orbital trap.

In the case of FIG. 10, the last ion guide is used in an ion storage mode (an ion storage device) where the ions are first trapped inside the storage device by applying a trapping DC voltage on the storage device exit electrode. The ions are extracted from the storage device for injecting them into the orbital trap by applying an extractive voltage to the exit end electrode (the storage device DC bias voltage may be adjusted before the ion extraction to match the final ion energy after the extraction to the voltage applied to the orbital trap inner electrode). A pulse ion extraction lens system is typically used for focusing ions in space and time.

In one embodiments of this invention, the inventive orbital trap can be used in an orbital trap mass spectrometer including high performance OTMS where the ion guide of the storage device is separated into several sections with the one closer to the exit having deeper potential well so ions are accumulated mostly in this last section before applying the extraction sequence voltages. In one embodiments of this invention, an alternative to the ejection along the storage device axis is the ejection to the direction perpendicular to the storage device axis (so called C-trap design—see U.S. Pat. No. 6,872,938).

Typically, to minimize the gas load on the vacuum pumps the ions extracted from the storage device go through an ion steering system and a gas restrictor to avoid major gas load from entering the last vacuum section. A high vacuum (typically at $10^{-10}$ Torr level) is maintained in the last vacuum section to provide virtually collisionless motion of ions inside the orbital trap after injection and trapping.

The injected ions are trapped inside the orbital trap using an electrodynamic squeezing technique in which the ion injection process is synchronized with the application of an attractive high voltage ramp on the orbital trap inner electrode (typically −3.5-5 kV during 30-150 μs for positive ions; the outer electrodes are typically grounded). The ions are injected into the trap during the last 20-35% of the high voltage ramp as a short bunch (typically less than few microseconds).

After injection and trapping, the ions are excited to bring the ions into a coherent oscillatory motion along z axis with a predetermined operational amplitude (7-9 mm in the inventive trapping electrodes corresponding to $R_m$=22 mm as described above). The excitation can be achieved by application of an AC voltage between the trap outer electrodes at the ion axial oscillation frequency (a dipole excitation) or to the inner electrode at the double frequency of the ion axial oscillations (a quadrupole or parametric excitation).

In various embodiments of this invention, for analysis of ions over a broad mass range, the excitation at multiple frequencies or in a broad frequency range is used (a broadband excitation). The ion's motion after the excitation can be detected by measuring a current induced by the coherent motion of the ions along the longitudinal axis z on the trap outer electrodes. After amplification, the current is digitized and recorded by the detection system. Frequency analysis of the measured signal is typically done using magnitude-mode Fourier transform technique (but other methods can also be used, like absorption-mode Fourier transforms, wavelet and chirplet transforms, shifted-basis techniques, or filter-diagonalization method). The frequency components in the measured signal are directly related to the ion's mass-to-charge ratios using a calibration procedure.

In one embodiment of the inventive orbital trap mass spectrometer, the ion beam current is measured using an electron multiplier detector between the ion-induced current measurement cycles and the ion population in the orbital trap is controlled to avoid negative space charge phenomenon based on these ion beam current measurements by adjusting the period of accumulating the ions in the storage ion device (before ejecting them into the orbital trap). A Faraday cap device can be used instead of the electron multiplier as well.

In addition to MS analysis mode, in one embodiment of this invention, the mass spectrometer described in the above embodiment can also be configured to be operated in a tandem MS (or MS/MS) mode. In this mode using a procedure widely used in commercial Orbitrap LTQ mass spectrometers (Thermo Fisher Scientific, Inc.), the ions of interest before ejecting the ions into the orbital trap for mass analysis are first isolated and then fragmented into the ion fragments in the ion storage device. After the fragmentation step, the fragment ions are injected, trapped, excited and detected using normal techniques as usually done in the regular MS mode described above.

Figure 11:
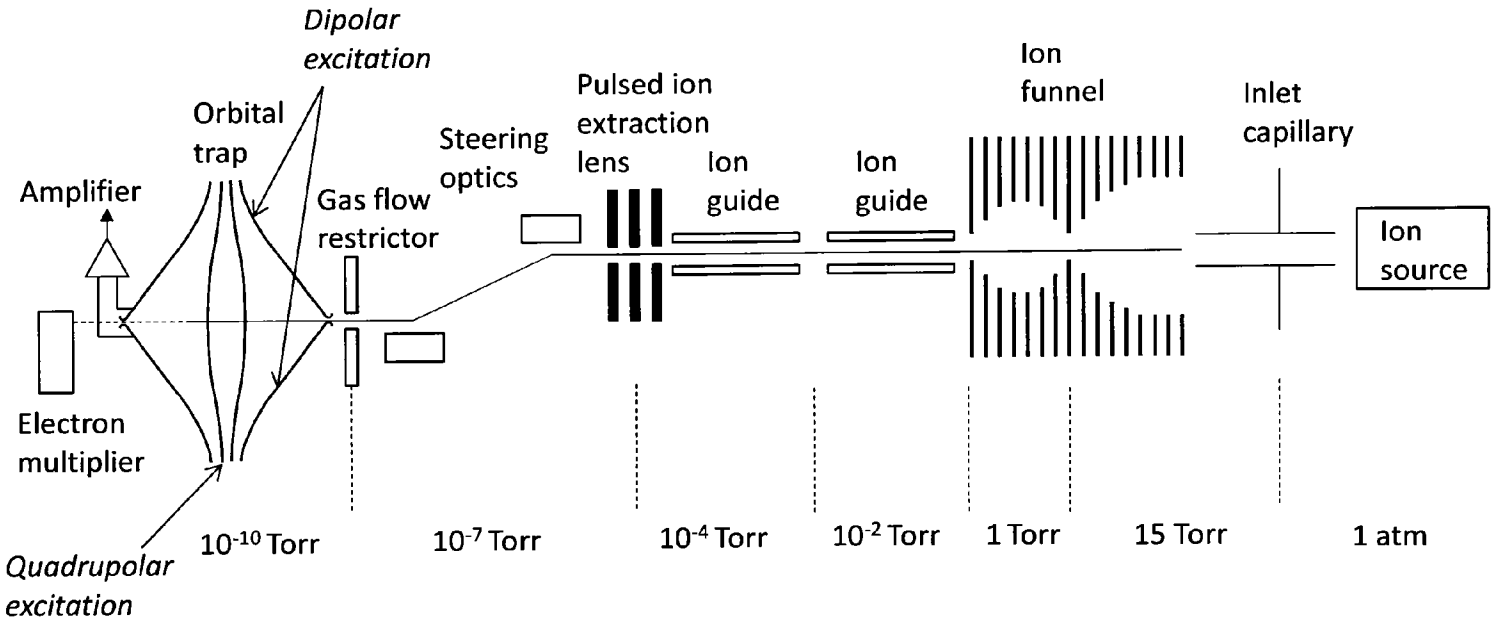
FIG. 11 is a schematic representation of another embodiment of a mass spectrometer based on the inventive orbital ion trap design utilizing an ion funnel to create a continuous ion beam for injection into the orbital trap.

In another embodiment of a mass spectrometer using the inventive orbital trap shown in FIG. 11, a continuous ion beam is used for the ion injection (without using an ion storage device for ion accumulation prior the injection). In this case, to increase the efficiency of introduction of ions into the vacuum of the mass spectrometer, an ion funnel device is used (see R. Smith et al., J. Am. Soc. Mass Spectrom., 2006, v. 17, p. 1299-1305). An ion funnel is a type of ion guide made with segmented ring electrodes where the orifices in the ring electrodes vary along the ion pass way. RF (50-1000 $V_{p-p}$) voltages is applied to the ring electrodes (typically, out-of-phase ones to the neighboring electrodes) to focus ions toward the ion funnel central axis and also DC voltages are applied to the ring electrodes to drive ions toward the funnel exit orifice. The use of an ion funnel has been shown to increase the intensity of the ion beam introduced into a mass analyzer by 10-100 times that will permit the operation of the inventive mass spectrometer without using an external storage device, thus, making its design simpler.

The ion funnel can include two sections separated by a small (typically 1.5-2 mm diameter) orifice that are pumped separately. A higher pressure in the first section (typically 10-30 Torr) allows more gas to flow through the inlet capillary, thus, reducing ion losses and bringing more ions from the ion source. The DC bias voltage on the inlet capillary and ion guides downstream the ion source should be adjusted to achieve the optimal energy of the injected ions at the orbital trap entrance. The ions are still trapped by ramping the voltage on the trap inner electrode (typically to −3.5-5 kV for positive ions) using the electrodynamic squeezing method. The HV ramp duration can be adjusted to increase number of ions injected into the trap (typically 100-10000 μs). Only ions injected during the last 20-35% of the ramp period will typically be trapped without striking the central inner electrode.

In various embodiments of this invention, to reduce the noise during ion detection, the ion beam (after the ion injection period) is blocked from entering the orbital trap. This can be done by applying a blocking DC voltage (typically up to few keV) on one of the electrodes downstream the ion source (for example, on one of the steering lens), or disabling the RF voltage applied to one or all ion guides, or steering the beam away from the flow restrictor orifice (in the ion steering vacuum section in FIG. 11). In the latter case, the ion current can be measured while the ions are processed in the orbital trap (for example, by using the flow restrictor as a detector area in the Faraday cap device) and the measured current can be used to control the ion population in the orbital trap, for example, by varying the trapping and drifting electric fields inside the ion funnel. The electron multiplier can be used instead of the faraday cap device. After injection, the ions trapped inside the orbital trap are excited and detected similarly to that in the previous embodiment.

It is also understood that other devices focusing ions at pressures higher than 10 Torr can also be used instead of the ion funnel in the embodiment shown in FIG. 11. For example, a miniature multipole ion guide can be operated with a high frequency drive voltages (typically, 1.5-2.5 MHz) as described in the U.S. Pat. No. 8,440,964.

Numerous modifications and variations of the invention are possible in light of the above teachings. It is therefore to be understood that within the scope of the appended claims, the invention may be practiced otherwise than as specifically described herein.

The invention claimed is:

1. An orbital trap for trapping ions using an electrostatic field, comprising:

an electrode structure defining an internal volume of the trap with at least some of electrode surfaces shaped to substantially follow equipotential lines of an ideal quadro-logarithmic electric potential around a longitudinal axis z, said ideal electric potential having an inner potential canyon, an outer potential canyon, and a low potential passage therebetween; and a trapping voltage supply which provides trapping voltages on the electrodes to generate a trapping electrostatic potential within the internal volume of the trap, said trapping electrostatic potential closely approximates at least a part of said ideal electric potential in at least a part of the internal volume of the trap;

wherein said approximated part of the ideal electric potential includes said low potential passage between the inner and outer potential canyons of the ideal electric potential and at least a part of the inner potential canyon adjacent to said passage.

2. A mass spectrometer comprising:

an ion source to generate ions from a sample;

the orbital trap of claim 1 for trapping ions inside the internal volume of said trap, said orbital trap being located inside a vacuum of the mass spectrometer; and an ion delivery mechanism which injects at least a part of said ions into said trap internal volume.

3. The mass spectrometer of claim 2, wherein the ion source is located inside the vacuum of the mass spectrometer.

4. The mass spectrometer of claim 2, wherein the ion source is located outside the vacuum of the mass spectrometer at substantially atmospheric pressure conditions, and the ion delivery mechanism comprises an atmospheric pressure interface configured to deliver at least part of said ions from the ion source into the vacuum of the mass spectrometer.

5. The mass spectrometer of claim 2, wherein the electrode structure of the trap includes:

at least one inner electrode and at least two outer electrodes extended along the longitudinal axis z, said at least one inner electrode and said at least two outer electrodes having at least some of respective surfaces thereof shaped to substantially follow equipotential lines of said ideal electric potential;

said at least one inner electrode having at least some of the surface shaped to substantially follow equipotential lines of the inner potential canyon of said ideal electric potential;

at least one gap between said at least two outer electrodes with a vicinity of said at least one gap being a part of the internal volume of the trap, and the trapping electrostatic potential in at least a part of the vicinity of said at least one gap closely approximates at least a part of the ideal electric potential including at least part of said low potential passage between the inner and outer potential canyons and at least a part of the inner potential canyon adjacent to said passage.

6. The mass spectrometer of claim 2, where said approximated part of the ideal electric potential further includes at least a part of the outer potential canyon adjacent to said low potential passage between the inner and outer canyons.

7. The mass spectrometer of claim 5, wherein the trapping electrostatic potential in at least a part of the vicinity of said at least one gap closely approximates at least a part of the ideal electric potential including at least part of said low potential passage between the inner and outer potential canyons and at least a part of the inner and outer potential canyons adjacent to said passage.

8. The mass spectrometer of claim 7, where said electrode structure further comprises:

a third outer electrode and the trapping electrostatic potential near at least a part of said third outer electrode closely approximates at least a part of the ideal electric potential including the outer potential canyon of said ideal electric potential.

9. The mass spectrometer of claim 8, wherein the third outer electrode has at least one surface shaped to substantially follow equipotential lines of the outer potential canyon of said ideal electric potential.

10. The mass spectrometer of claim 5, wherein the trapping electrostatic potential within said internal volume is generated by providing the trapping voltage attracting the ions to said inner electrode.

11. The mass spectrometer of claim 2, wherein the ion delivery mechanism includes at least one of an ion funnel, a quadrupole ion guide, a multipole ion guide, and an electrostatic ion optical lens.

12. The mass spectrometer of claim 2, wherein the ion delivery mechanism includes an ion storage device.

13. The mass spectrometer of claim 5, wherein said at least a part of the ions are injected into the internal volume of the trap through said at least one gap between the at least two outer electrodes.

14. The mass spectrometer of claim 2, wherein the trapping electrostatic potential inside the internal volume of the trap is changed in time during the injection of the ions into the internal volume.

15. The mass spectrometer of claim 2, wherein the trapping electrostatic potential inside the internal volume of the trap and energy of the injected ions are changed in time during the injection of the ions into the internal volume.

16. The mass spectrometer of claim 2, further comprising an excitation mechanism to excite at least a part of the ions trapped inside the trap internal volume along said longitudinal axis z.

17. The mass spectrometer of claim 16, wherein said excitation mechanism is configured to apply an excitation voltage to at least one of the electrodes of said electrode structure.

18. The mass spectrometer of claim 5, further comprising an excitation mechanism to excite at least a part of the ions trapped inside the trap internal volume along said longitudinal axis z.

19. The mass spectrometer of claim 18, wherein said excitation mechanism is configured to apply an excitation voltage to said at least one inner electrode of said electrode structure.

20. The mass spectrometer of claim 18, wherein said excitation mechanism is configured to apply an excitation voltage between said two outer electrodes of said electrode structure.

21. The mass spectrometer of claim 2, further comprising an ion detector configured to detect at least a part of the ions trapped inside the trap internal volume.

22. The mass spectrometer of claim 21, wherein said ion detector is configured to measure a current induced by motion of said at least a part of the ions along the longitudinal axis z on at least one of the electrodes of said electrode structure.

23. The mass spectrometer of claim 22, wherein said induced current is measured between said two outer electrodes.

24. The mass spectrometer of claim 22, wherein said ion detector includes a frequency analyzer for analysis of the measured induced current.

25. The mass spectrometer of claim 24, wherein said frequency analysis includes at least one of magnitude-mode Fourier transform, absorption-mode Fourier transform, wavelet and chirplet transforms, shifted-basis technique, and filter-diagonalization method.

26. The mass spectrometer of claim 2, wherein the ion delivery mechanism injects said at least a part of said ions into said trap internal volume repetitively.

27. The mass spectrometer of claim 26, further comprising an ion current measurement device which measures an ion current from the ion source between repetitive injections of the ions into the internal volume of the trap.

28. The mass spectrometer of claim 27, wherein said ion current measurement device includes at least one of an electron multiplier detector and Faraday cap device.

29. The mass spectrometer of claim 28, wherein said ion current measurements are used to control the number of ions delivered to the internal volume of the trap by said ion delivery mechanism.

30. A method of mass spectrometry analysis utilizing the orbital trap of claim 1, comprising steps of:

ionizing sample molecules to obtain sample ions, delivering and injecting at least part of said sample ions into said orbital trap, exciting at least a part of the ions injected into said orbital trap to obtain a coherent oscillating motion of said ions along the longitudinal axis z, and measuring a current induced by the coherent motion of said at least a part of the ions along the longitudinal axis z on at least one of the electrodes of the electrode structure of said orbital trap.

31. The method of claim 30, wherein the step of delivering further comprises a step of isolation of a part of the sample ions to produce isolated ions within at least one pre-determined mass-to-charge ratio range.

32. The method of claim 31, wherein the step of delivering further comprises a step of fragmentation of at least a part of said isolated ions to obtain ion fragments.

* * * * *